US006565318B1

(12) United States Patent
Tiemann

(10) Patent No.: US 6,565,318 B1
(45) Date of Patent: May 20, 2003

(54) CAST GAS TURBINE BLADE THROUGH WHICH COOLANT FLOWS, TOGETHER WITH APPLIANCE AND METHOD FOR MANUFACTURING A DISTRIBUTION SPACE OF THE GAS TURBINE BLADE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/937,829

(22) PCT Filed: Mar. 23, 2000

(86) PCT No.: PCT/EP00/02606

§ 371 (c)(1),
(2), (4) Date: Sep. 28, 2001

(87) PCT Pub. No.: WO00/58606

PCT Pub. Date: Oct. 5, 2000

(30) Foreign Application Priority Data

Mar. 29, 1999 (EP) ..... 99106454

(51) Int. Cl.[7] ..... B64C 11/00; F01D 5/18
(52) U.S. Cl. ..... 416/97 R
(58) Field of Search ..... 415/117; 416/97 R, 416/95, 92

(56) References Cited

U.S. PATENT DOCUMENTS

| | | | |
|---|---|---|---|
| 3,582,230 | A | 6/1971 | Schmidt |
| 3,918,835 | A | 11/1975 | Yamarik et al. |
| 4,203,705 | A | 5/1980 | Wesbecher |
| 4,344,738 | A | 8/1982 | Kelly |
| 4,992,026 | A | 2/1991 | Ohtomo |

FOREIGN PATENT DOCUMENTS

| | | |
|---|---|---|
| EP | A2224082 | 4/1990 |
| EP | A1894941 | 2/1999 |
| GB | 2224082 | 4/1990 |

*Primary Examiner*—Edward K. Look
*Assistant Examiner*—Kimya N McCoy
(74) *Attorney, Agent, or Firm*—Harness, Dickey & Pierce PLC

(57) ABSTRACT

A cast gas turbine blade through which coolant flows, includes a blade root inserted into a disk of the gas turbine; a plurality of supply ducts; and a distribution space. Coolant is fed to the supply ducts through. a feed duct of the disk, the feed duct communicating with the supply duct via the distribution space. Flow and manufacture are optimized by a cast distribution space being present which has rounded or beveled inlet openings for the supply ducts and which is manufactured by means of a one-piece casting core.

19 Claims, 3 Drawing Sheets

CAST GAS TURBINE BLADE THROUGH WHICH COOLANT FLOWS, TOGETHER WITH APPLIANCE AND METHOD FOR MANUFACTURING A DISTRIBUTION SPACE OF THE GAS TURBINE BLADE

This application is the national phase under 35 U.S.C. §371 of PCT International Application No. PCT/EP00/02606 which has an International filing date of Mar. 23, 2000, which designated the United States of America, the entire contents of which are hereby incorporated by reference.

FIELD OF THE INVENTION

The invention relates to a cast gas turbine blade/vane through which coolant flows, in particular a gas turbine rotor blade with a blade root, which is inserted into a rotatable disk of the gas turbine and which has a plurality of supply ducts for an internal cooling system, and a distribution space. Preferably, it is possible to feed coolant to the supply ducts by way of a feed duct of the disk, wherein the feed duct communicates with the supply ducts via the distribution space. The invention also preferably relates to an appliance, for casting a gas turbine blade/vane, having a casting core which has core ribs forming the supply ducts. Finally, the invention also preferably relates to a method of manufacturing a cast gas turbine blade/vane.

BACKGROUND OF THE INVENTION

From U.S. Pat. No. 4,344,738, a gas turbine blade/vane is known which is inserted by means of a blade root into a transverse groove of a rotatable disk of the gas turbine, the disk having a feed duct for supplying the gas turbine with coolant. Below the blade/vane root, the feed duct opens into the disk transverse groove intended for accommodating the blade/vane root. Supply ducts, through which the coolant is fed into the internal cooling system, emerge from the blade root. The supply ducts have, in the main, inlet openings with edges.

U.S. Pat. No. 4,992,026 reveals a gas turbine blade/vane through which a coolant flows and which has an internal cooling system, the coolant being introduced by feed ducts into the blade root and fed through supply ducts into the internal cooling system. At their transitions from the blade root, the supply ducts have right-angle edges.

The object of the internal cooling of the gas turbine blade/vane is to prevent severe heating of the blade/vane material, which occurs due to high operating temperatures and can lead to serious damage. For this purpose, it is necessary that the cooling medium should, without difficulty, reach the gas turbine blade/vane parts which, in particular, are remote from the inlet flow region and are exposed to the most severe effects. In the vicinity of the supply duct inlets which, however, have practically no cooling requirement, dead zones occur. Further, the flows depart greatly from the ideal laminar process in the case of inlets, which are greatly constructed with edges, to the supply ducts leading to the internal cooling system, such as is published in U.S. Pat. No. 4,344,738 or U.S. Pat. No. 4,992,026, for example. This, for example, involves an increased danger of the formation of deposits and, in particular, a high flow resistance. It is only possible to force the cooling medium through the supply passages by means of an increased pressure and this is frequently impossible to a sufficient extent.

A further possibility for forming the supply duct region in the lower blade root consists in providing a so-called distribution space from which the supply ducts for the internal cooling system emerge and which is supplied with coolant by the feed duct in the disk. Essentially, the distribution space should serve to provide a reliable and uniform distribution of the coolant to the supply ducts and it is only permissible for small coolant losses to occur. In the usual casting process, this distribution space generally has a rectangular configuration and has, in particular, right-angle transitions between the supply ducts and distribution space. Due to the construction with edges of the inlets to the supply ducts, strong flow eddies occur which, in principle, ensure good cooling of the regions over which flow occurs. Because, however, the distribution space is in the blade/vane root, it is not subject to severe heating effects and has, therefore, only a small cooling requirement.

This state of affairs can be improved by mechanical reworking, after the casting process, of the supply duct inlets from the distribution space. Because of the geometry of the blade root and the properties of the blade/vane material, however, this must generally take place manually and is, in consequence, very labor-intensive. Furthermore, this procedure does not ensure that all the supply ducts of a gas turbine blade/vane have the desired shape and that all the gas turbine blades/vanes of a type have the same flow resistance. This, however, would be necessary for a calculation in advance of the flow properties which would satisfy the high quality requirements and would be necessary for optimum utilization of the cooling medium.

SUMMARY OF THE INVENTION

An object of the invention is therefore to provide a cast gas turbine blade/vane, in particular a gas turbine rotor blade, through which coolant flows. It further preferably has transitions from the distribution space to the supply ducts which are optimized in terms of flow, i.e. which has low flow resistance at the outlet openings from the distribution space. An object is to be able to manufacture the distribution space and the internal cooling system in a single manufacturing process, the casting process. A further object of the invention includes providing an appliance and a method for manufacturing such a cast gas turbine blade/vane, through which coolant flows, with a corresponding distribution space.

An object directed toward a cast gas turbine blade/vane through which coolant flows is achieved by a cast distribution space being present which has rounded or beveled inlet openings to the supply ducts, for example.

The rounded or beveled inlet openings to the supply ducts, which are adjacent to the distribution space, ensure that the flow resistance to the cooling medium is minimized, particularly in the transition region between the distribution space and the supply ducts. The cooling medium flow remains substantially laminar. The coolant can therefore—given an appropriate edge-free transition solution from the feed duct to the distribution space—flow almost unhindered into the distribution space and out of it through the supply ducts. In this way, it reaches the internal cooling system rapidly and with low losses, which leads to a greatly increased service life, particularly in the case of the hot and coolant-intensive regions of the gas turbine blade/vane, for example the leading edge region. The coolant supplied is thus utilized better.

It is no longer necessary for the medium supplied through the feed duct of the disk to be guided round two 90° angles into the internal cooling system. On the contrary, it is fed directly to the internal cooling system in a smooth, continuous flow motion. No cavitation, in which the coolant is at rest as in dead zones, occurs while the cooling medium flows round. Because of the rounding or beveling of the inlet openings, the cooling medium supplied is only eddied to a very slight extent.

The inlet openings to the supply ducts abut directly onto the distribution space and are generated with it during one manufacturing process. The rounding or beveling is shaped by the casting process in a reproducible manner. In this way, a series of gas turbine blades/vanes can have the same, predetermined sizes and dimensions for the inlet openings and the distribution space. This provides the basis for a reliable determination in advance of the coolant requirement and/or the coolant function. This is particularly important for ensuring that even remote parts of the gas turbine rotor blades are reliably cooled and that, therefore, the wear due to overheating is minimized.

Due to the present invention, the coolant has already been introduced through the distribution space into the supply ducts at a low pressure because of the low flow resistance and it therefore escapes to only a small extent through the intermediate space between the blade root and rotating gas turbine disk. By this means, the coolant losses are minimized and the coolant is utilized in an optimum manner.

Because the distribution space has a configuration rounded in the manner of an ellipsoid, the cooling air can be fed particularly advantageously to the supply ducts. In this arrangement, the distribution space is preferably configured in the form of a semi-ellipsoid. Its base area also corresponds to the maximum cross section of the ellipsoid and, in the case of a gas turbine blade/vane inserted in a disk groove, is bounded by the disk. The side surfaces of the semi-ellipsoid, and also the transitions between the side surfaces, have a rounded configuration. This simple geometry can be easily manufactured and reliably prevents the formation of dead zones in which the coolant introduced comes to rest. Due to the absence of edges, only slight eddying, which leads to negligible flow losses, occurs on the walls of the distribution space. The ellipsoid-type shape makes it possible to direct the coolant supply in a specific manner to the supply ducts adjacent to various regions of the ellipsoid.

A further optimization of the coolant flow is achieved by the rounded or beveled inlet openings meeting one another or being adjacent to one another in a manner which optimizes the flow. Optimized in terms of flow means that the flow deflections necessary due to the position of two inlet openings relative to one another or due to the position of the distribution space and an inlet opening relative to one another take place with the smallest possible amount of flow eddying. In particular, this takes place because the edges, which occur due to the meeting of the respective curvatures of the inlet openings, are in turn rounded off. The optimization of the shape preventing flow eddying is produced in the casting process by the employment of the rounded, one-piece cast core in a manner which can be individually matched without reworking to the requirements set for a certain type of gas turbine.

A predetermined supply of coolant can be easily adjusted by the cross section of the feed duct and the local changes to the cross sections of the distribution space being matched to the cross sections of the outlet openings located downstream. The cross-sectional changes to the height and width of the distribution space correspond, for example, to the shape of a semi-ellipsoid. The transitions between the inlet openings or around the inlet openings are designated as transition cross sections. The rounding or beveling of the inlet openings produces a larger inlet opening cross section directly at the distribution space and this cross section is then reduced again on transition to the supply duct. The feed duct has an essentially constant cross section but it can also be rounded or beveled in order to improve the flow properties, thus increasing the cross section in the direction toward the distribution space. The cross sections described are matched to one another, i.e. predetermined cross-sectional relationships are taken into account in the matching of the coolant supply. This is necessary if, for example, an increased coolant requirement exists because of a high operating temperature or because of special configurations of the internal cooling system in a gas turbine blade/vane, which configurations require high coolant pressures or exhibit a high leakage rate.

In the case of different coolant requirements at different locations in the internal cooling system, it is advantageous for a plurality of supply ducts to be present with different cross sections and transition cross sections of the inlet openings, which transition cross sections are respectively matched to the differ-ent cross sections. In this way, the coolant can be individually matched to the coolant requirements of the different regions of the gas turbine blade/vane. By this, the coolant consumption is reduced to the necessary extent. The manufacture of the supply ducts of different sizes or the manufacture of cross sections of different sizes is possible in one casting manufacturing process. It is only necessary to match the diameter of the core rib to this requirement.

In order to obtain a large distribution space with reduced flow eddies, it is advantageous for the lowest longitudinal rib of the blade root, which is nearest to the axis of rotation of the gas turbine, to extend along a principal axis of the gas turbine blade/vane. The blade root is held, by way of its longitudinal ribs, on undercuts of the disk groove into which it is inserted. The distribution space for the cooling medium is accommodated in the lowest longitudinal rib. In order to achieve the largest possible distribution space, and therefore little eddying of the coolant, the blade root according to the invention is lengthened in the region of the lowest longitudinal rib. This lengthening takes place along the principal axis of the gas turbine blade/vane i.e. at right angles to the periphery of the disk when the gas turbine blade/vane has been inserted. Due to the lengthened configuration of the lower longitudinal rib, the stability of the holding appliance in the blade root is further ensured and the rib can be easily lengthened in the manufacturing process of the gas turbine blade/vane by the core root of the casting core having a thicker configuration.

For the manufacture of the gas turbine blade/vane, in particular for the subsequent machining of the blade root and for ensuring adequate stability, it is advantageous for the inlet openings of the supply ducts to be located at the level of the transition flank between the lowest longitudinal rib and the longitudinal rib located above it. This ensures that the region of the distribution space is only surrounded by the lowest longitudinal rib. A transition flank, whose slope ensures secure holding of the blade root of the gas turbine blade/vane in the undercut of the disk is provided, is located between two longitudinal ribs. The arrangement proposed for the inlet openings of the supply ducts ensures that subsequent work on the blade root after the casting process can take place in a defined region without the blade/vane being damaged, the region of the distribution space being located in each case within the lowest longitudinal rib. The lengthening of the longitudinal rib can therefore be almost arbitrarily adjusted.

The object directed toward a casting appliance for the manufacture of a gas turbine blade/vane with a distribution space is achieved, for example, by an appliance for casting a gas turbine blade/vane having a casting core. It further preferably has core ribs forming the supply ducts, the casting core having a core root forming the distribution space. The core ribs are preferably formed in one piece with that core root, with a continuous transition being present from the core root to the core ribs.

In addition to an outer shell, the casting appliance has an inner casting core. The casting core is used when casting the gas turbine blade/vane in order to keep a predetermined, inner region of the gas turbine blade/vane free from cast material. The region kept free comprises the inner cooling system, the supply ducts and the distribution space. The supply ducts are kept free by elongated extensions of the casting core, the so-called core ribs. The distribution space is formed by a region which is widened relative to the core ribs and has a certain thickness and height, the so-called core root. The core root is configured in one piece with the core ribs. The one-piece configuration of the two parts of the casting core permits a rounded configuration of the transition between the supply ducts and the distribution space.

The rounded configuration of the transition between the supply ducts and the distribution space always occurs in the same manner, as specified by the shape of the casting core. This permits exact maintenance of predetermined dimensions. It permits desired dimensions of the internal cooling system of the gas turbine blade/vane to be ensured in such a way that they can be reproducibly adjusted for a complete series of gas turbine blades. This provides a basis for a low-cost and reliable manufacture of internally cooled gas turbine blades/vanes.

Because the casting core is configured in one piece, it is very stable with respect to the deformation forces which appear due to the solidification of the melt.

The transition from the core root to the core ribs is designed, in such a way that it takes place continuously in each case, by the cross section being preferably continuously increased from the core ribs to the core root. Because of the continuous transition from the core ribs into the core root, no reworking of the inlet openings of the supply ducts is necessary after the casting process in order to ensure a low flow resistance. This correspondingly dispenses with one operational step in the manufacture of the gas turbine blade/vane.

It is advantageous for the core ribs to merge into the core root with increasing cross section, which core root has a thickness which is larger than the thickness of the core ribs. This permits an additional substantial reduction in the flow resistance of the coolant flow.

A further improvement to the flow properties of the transition from the distribution space to the supply ducts is provided by the rounded core ribs running out into a curved surface which ends in the core root. This surface forms a throat, which is provided before the actual inlets to the supply ducts and which supports a continuous and low-eddy deflection of the coolant flow into the supply ducts. In addition, such a casting core is simpler to manufacture and can also be calculated more satisfactorily with respect to its flow properties.

The task directed toward a method of manufacturing a gas turbine blade/vane, using an appliance as described for the casting, is achieved by the distribution space and the supply ducts being cast using the one-piece casting core.

Due to the use of the one-piece casting core, the casting process is dimensionally more accurate and, at the same time, less time-consuming, because the individual parts of the casting core can be installed jointly. With this method, the distribution space no longer needs to be subsequently recessed mechanically. This complicated measure, which has essentially to be carried out manually, represents a time-consuming and costly step in the manufacture of a gas turbine blade/vane with distribution space. The use of the one-piece casting core, as proposed, now makes this process superfluous. In addition, the dimensions, and therefore the coolant flow through the inlet openings of the supply ducts and the distribution space, can be reproducibly adjusted.

If, however, further changes to the distribution space and/or to the inlet openings of the supply ducts are still necessary and/or desirable, the distribution space can be mechanically reworked as a supplementary measure. As compared with the usual mechanical working, this is simplified by the fact that the major part of the material to be removed is already lacking due to the casting process. Only small corrections, which involve little manufacturing complication, have therefore to be carried out.

BRIEF DESCRIPTION OF THE DRAWINGS

The gas turbine blade/vane, the appliance and the method for manufacturing the gas turbine blade/vane with a cast distribution space are explained in more detail using the embodiment examples shown in the drawings. In these.

DETAILED DESCRIPTION OF THE PREFERRED EMBODIMENTS

Figure 1:
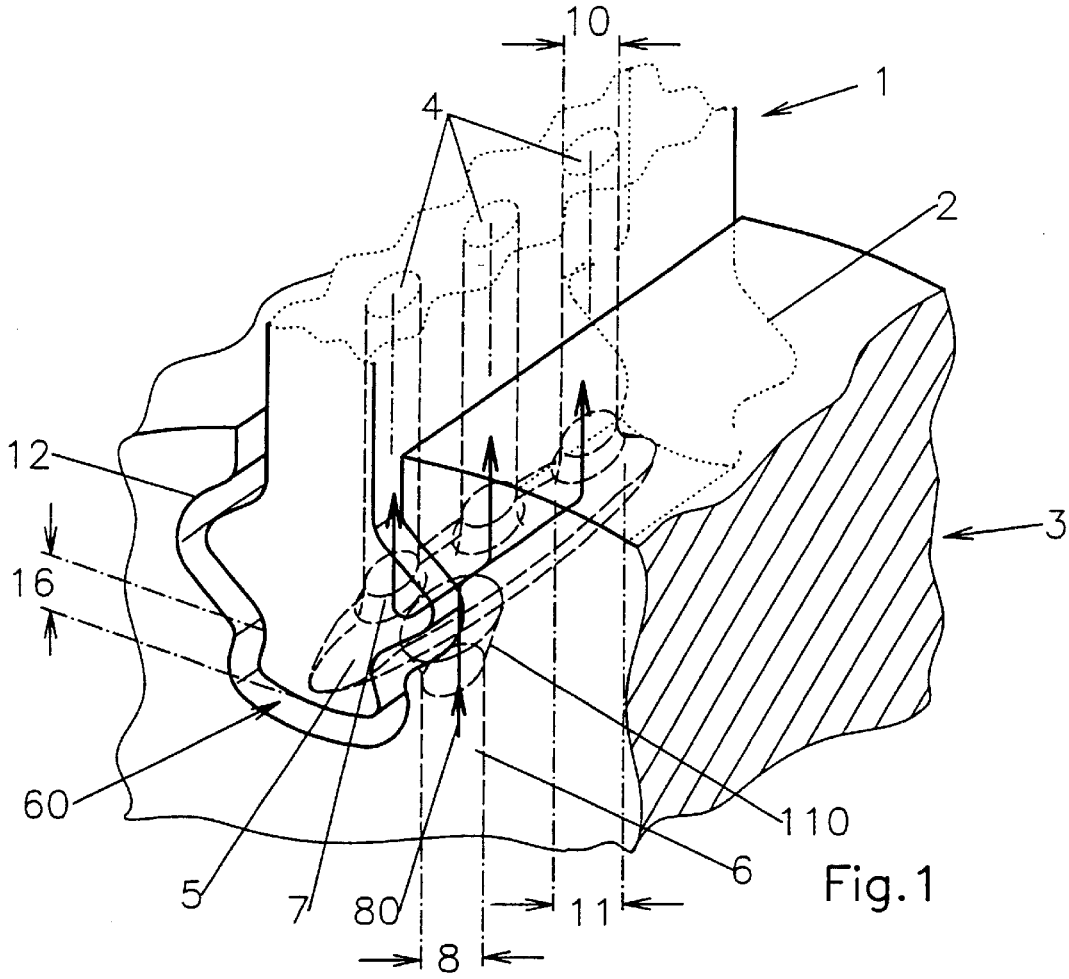
FIG. 1 shows, in perspective side view, an excerpt from the disk and the blade/vane root.

FIG. 1 shows, diagrammatically and not to scale, a construction in principle of the root region of a gas turbine blade/vane 1, inserted in a disk 3 of a gas turbine. The disk 3 can be rotated about the rotational axis 14 of the gas turbine. The gas turbine blade/vane 1 is held by way of its blade/vane root 2, which has two longitudinal ribs 13, 13', in a disk transverse groove 60 of the disk 3. The blade/vane root 2 is supported on undercuts 12 of the disk 3, by way of its longitudinal ribs 13, 13', against the centrifugal forces acting parallel to the longitudinal direction 15 of the gas turbine blade/vane 15 when the disk 3 is rotating about the axis of rotation 14.

The disk 3 has a feed duct 6 and the blade/vane root 2 has a plurality of supply ducts 4, which are in flow connection with one another by means of a distribution space 5. Coolant 80 can be fed from the disk 3 into the internal cooling system of the gas turbine blade/vane 1 by means of this passage system. The coolant 80 is preferably cooling air. The distribution space 5 exhibits rounded or beveled inlet openings 7 of the supply ducts 4. In this way, the feed through coolant 80 is fed with minimum flow losses to the internal cooling system through the distribution space 5 and into the supply ducts 4.

At its base 70, the distribution space 5 is open toward the feed duct 6. Practically no flow losses, therefore, occur at this base 70. The distribution space 5 is rounded in the manner of an ellipsoid. In its cross-sectional shape parallel to its base 70, it has a shape of an ellipse which is contracting. In the cross-sectional area 9 at right angles to this, shown in FIG. 4*b*, it has the cross-sectional shape of a semi-ellipse with continuously changing cross section. This semi-elliptical shape is interrupted by the rounded inlet openings 7 of the supply ducts 4. The transitions between the inlet openings 7 of the supply ducts 4 and the semi-ellipse of the distribution space 5 have a rounded design so that they form no flow resistance worth mentioning. In this arrangement, the inlet openings 7 can be located both directly adjacent to one another, therefore meeting one another, or can be adjacent to one another.

The regions between the inlet openings 7 of the supply ducts 4 are rounded so as to optimize the flow, i.e. there are no edges present. This also applies to the cross sections 8 of the feed duct 6 in the disk 3 of the gas turbine. The cross section 8 of the feed duct 6 is preferably matched to the local changes in the cross sections 9 of the distribution space 5 at right angles to its base plane 70, as are the inlet openings 7 with the downstream cross sections 10. In this way, a coolant flow 80 necessary for cooling the remote regions of the gas turbine blade/vane 1 can be reliably set. The supply ducts 4 bound the distribution space 5 by way of different cross sections 10 and transition cross sections 11 respectively matched to them, and merging into the distribution space 5. In this way, a coolant flow 80 of different strengths, which depends in each case on the cross section 10 of the supply duct 4, can be introduced into a predetermined region of the internal cooling system. This permits individual matching of the cooling.

The gas turbine blade/vane 1, which is represented in FIG. 1, is manufactured in a single casting process, the distribution space 5 being formed by a casting core 18 with the core ribs 19, which keep the supply ducts 4 free of cast material. The distribution space 5 has a height 90, which approximately agrees with the height 16 of the distance from the lower part of the lower longitudinal rib 13 to the transition into the following longitudinal rib 13' of the blade/vane root 2. In order to obtain a large distribution space 5 with the lowest possible flow resistance, it is correspondingly advantageous for the lower longitudinal rib 13 to be lengthened along a principal axis 15 of the gas turbine blade/vane 1. In the case of a distribution space 5 enlarged in this way, only a small proportion of eddying of the coolant flow 80 is to be found within the distribution space 5 and on transition into the inlet openings 7.

Figure 2:
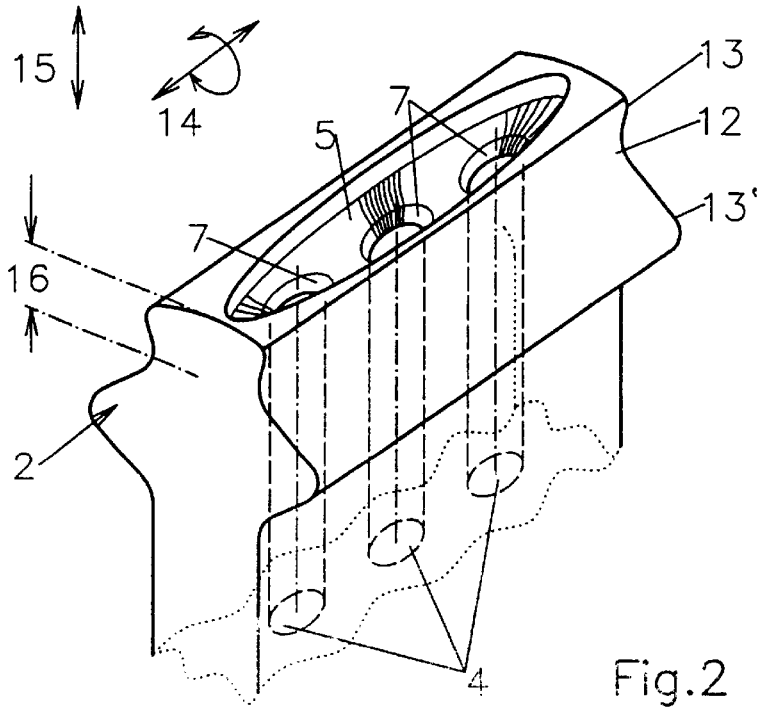
FIG. 2 shows a perspective view from below onto the blade/vane root and the distribution space.

FIG. 2 shows a plan view onto the base 70 of the blade root 2, in perspective view. Rounded and/or beveled inlet openings 7 of the supply ducts 4 emerge from the distribution space 5. The longitudinal ribs 13, 13' are configured with undercuts 12.

Figure 3:
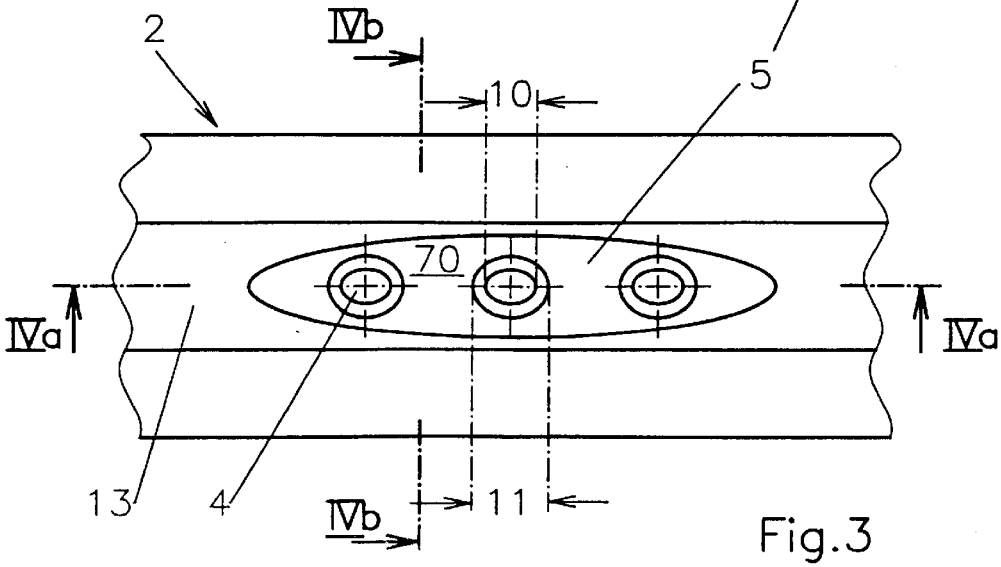
FIG. 3 shows a view from below onto the distribution space, the inlet openings and the supply ducts.

FIG. 3 shows a direct view onto the lower surface of the blade root 2. The supply ducts 4 have an oval or elliptical shape, which is particularly favorable to the flow. The inlet openings 7 are also, correspondingly, elliptically matched, the cross section of the elliptical inlet openings 7 continuously decreasing from the distribution space 5 to the supply ducts 4.

Figure 4A:
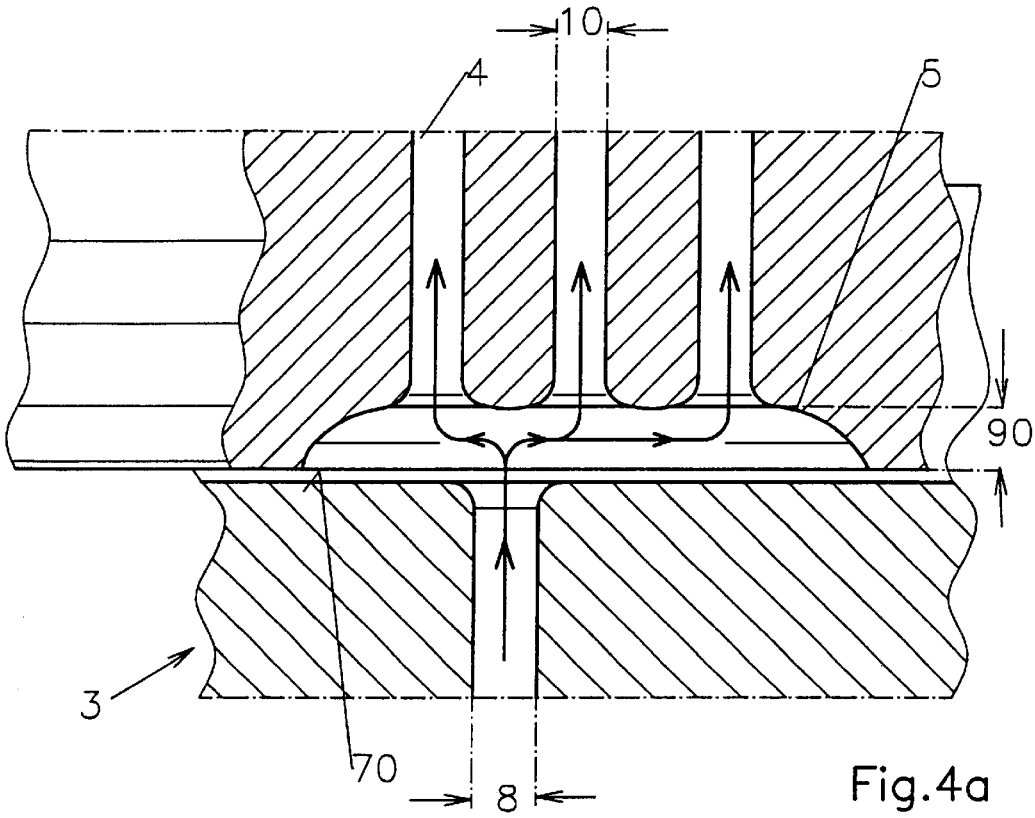
FIG. 4*a* shows a longitudinal section through a disk feed duct, the distribution space and the supply ducts of the blade/vane root of FIG. 3.

FIG. 4*a* shows a longitudinal section through blade/vane root 2 and disk 3. The coolant flow 80 passes from the feed duct 6, with diameter 8, into the distribution space 5 and, through the inlet openings 7, into the supply ducts 4. The coolant flow 80 is fed unhindered into the internal cooling system of the gas turbine blade/vane 1 through the rounded inlet openings 7 and the rounded distribution space 5 and likewise through the rounded opening 110 of the feed duct 6. The distribution space 5 has a maximum height 90.

Figure 4B:
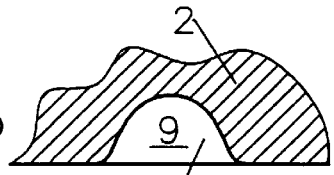
FIG. 4*b* shows a cross section through the distribution space of FIG. 3.

FIG. 4*b* shows a cross section through the view of FIG. 3. The blade/vane root 2 of the gas turbine blade/vane, which is intersected by the distribution space 5, is shown. The distribution space has an elliptical cross section with the cross-sectional area 9.

Figure 6:
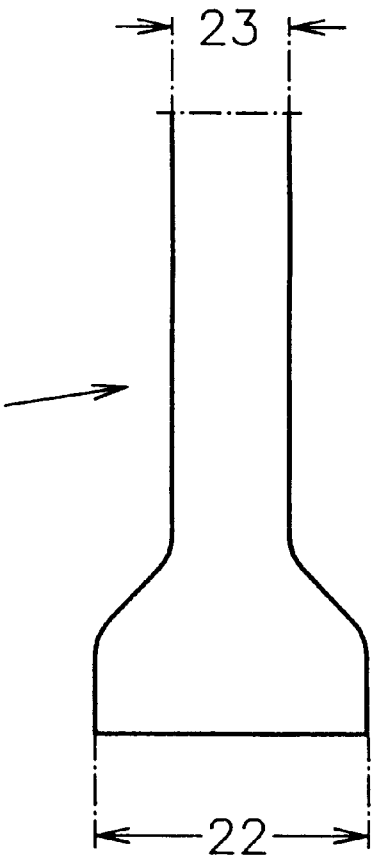
FIG. 5 shows a perspective side view of the lower part of the casting core and FIG. 6 shows a cross section through the core rib and the core root of FIG. 5.
Figure 5:
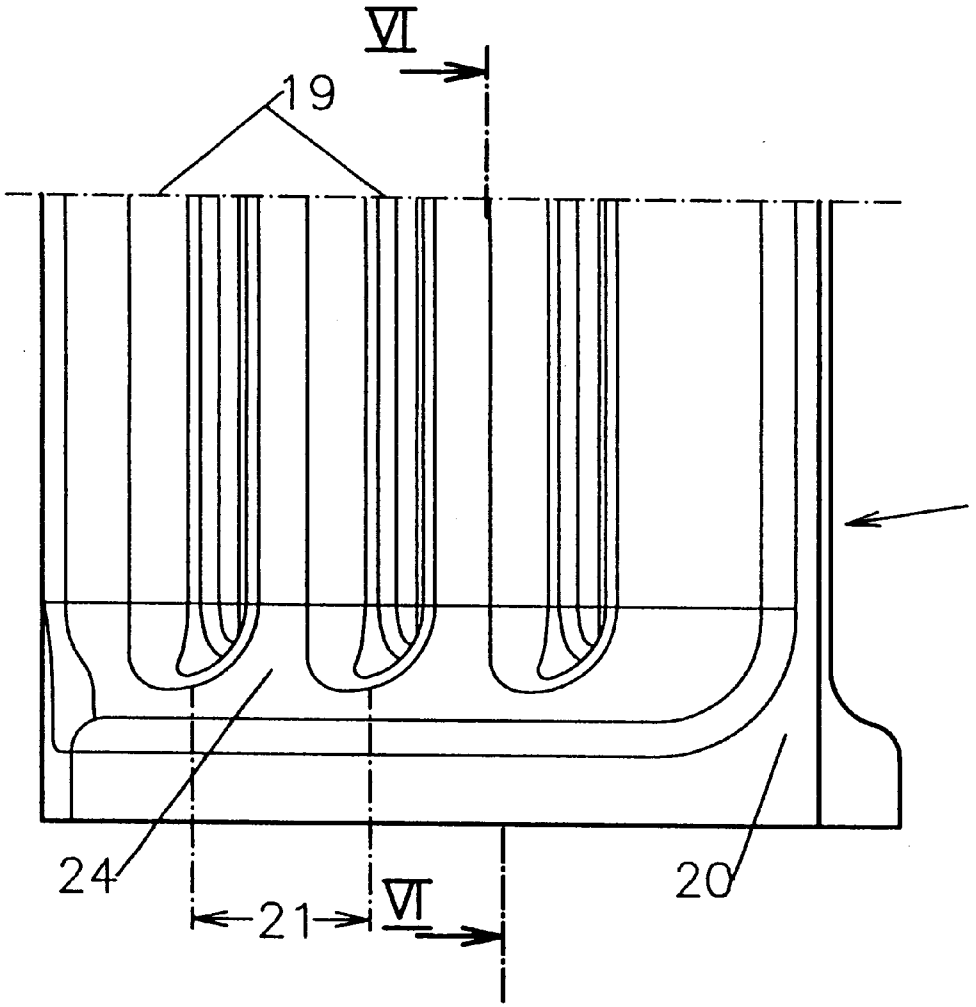

FIG. 5 shows a casting core 18, which represents the essential constituent part of the appliance for casting a gas turbine blade/vane 1. The casting core 18 has core ribs 19 and a core root 20. The core ribs 19, with the thickness 21, form the supply ducts 4 of the gas turbine blade/vane 1 during the casting operation. The core root 20 and the core ribs 19 have a one-piece configuration and the core ribs 19 merge with increasing cross section 21 into the core root 20. This transition takes place in a continuously increasing cross section 21 so that no step-changes to the thickness occur. The core ribs 19 are rounded and preferably run out into a curved surface 24 which ends in the core root 20. In this way, the distribution space 5 has a shape after the casting operation which is particularly favorable to the flow. FIG. 6 shows, in a longitudinal section through the core root 20 and a core rib 19, the continuous transition of the thickness 23 of the core rib 19 into the thickness 22 of the core root 20.

A casting core 18, as described above, is used during the manufacture of the gas turbine blade/vane 1 described above. It permits simple manufacture both of a large distribution space 5 and of a continuous transition from the distribution space 5 to the supply ducts 4 of the gas turbine blade/vane without reworking of the gas turbine blade/vane 1 being necessary in this region. It is, however, readily possible to mechanically rework such a cast gas turbine blade/vane 1 in its distribution space 5 in order, for example, subsequently to adapt the gas turbine blade/vane 1 to changed requirements or to use the same casting core 18 for different models. In this case, an essential part of the material to be removed is already kept free by the core root 20. The subsequent mechanical working is therefore only a correction, which can be carried out rapidly and at low cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A gas turbine blade through which coolant of an internal cooling system flows, comprising:

a blade root inserted into a rotatable disk of the gas turbine;

a plurality of supply ducts; and a distribution space, wherein coolant can be fed to the supply ducts through a feed duct of the disk, the feed duct communicating with the supply ducts via the distribution space, and wherein the distribution space is a cast distribution space including at least one of rounded and beveled inlet openings for the supply ducts.

2. The gas turbine blade as claimed in claim 1, wherein the distribution space is rounded in the manner of an ellipsoid.

3. The gas turbine blade as claimed in claim 2, wherein the inlet openings meet one another in a manner which optimizes the flow.

4. The gas turbine blade as claimed in claim 2, wherein the inlet openings are adjacent to one another in a manner which optimizes the flow.

5. The gas turbine blade as claimed in claim 1, wherein the inlet openings meet one another in a manner which optimizes the flow.

6. The gas turbine blade as claimed in claim 1, wherein a cross section of the feed duct and local changes to cross sections of the distribution space are matched to the cross sections of the outlet openings located downstream.

7. The gas turbine blade as claimed in claim 6, wherein a plurality of supply ducts are present with different cross sections and transition cross sections of the inlet openings, respectively matched to the different cross sections.

8. The gas turbine blade as claimed in claim 1, wherein a plurality of supply ducts are present with different cross sections and transition cross sections of the inlet openings, respectively matched to the different cross sections.

9. The gas turbine blade as claimed in claim 1, wherein the blade root includes longitudinal ribs, which engage in undercuts on the disk and of which a relatively lowest, which is relatively nearest to an axis of rotation of the gas turbine, is lengthened along a principal axis of the gas turbine blade.

10. The gas turbine blade as claimed in claim 9, wherein the inlet openings of the supply ducts are located at a level of a transition flank between a relatively lowest longitudinal rib and a next relatively lowest longitudinal rib located above it.

11. The gas turbine blade as claimed in claim 1, wherein the inlet openings of the supply ducts are located at a level of a transition flank between a relatively lowest longitudinal rib and a next relatively lowest longitudinal rib located above it.

12. An appliance for casting the gas turbine blade as claimed in claim 1 comprising:

a casting core, including core ribs forming the supply ducts, and a core root forming the distribution space, the core ribs being formed in one piece with the core root, and a continuous transition being present from the core root to the core ribs.

13. The appliance for casting a gas turbine blade as claimed in claim 12, wherein the core ribs merge into the core root with increasing cross section, the core root having a thickness which is relatively larger than the thickness of the core ribs.

14. The appliance for casting a gas turbine blade as claimed in claim 13, wherein rounded core ribs run out into a curved surface which ends in the core root.

15. A method for manufacturing a gas turbine blade using the appliance as claimed in claim 13, comprising:

casting the distribution space and the supply ducts using the casting core.

16. The appliance for casting a gas turbine blade as claimed in claim 12, wherein rounded core ribs run out into a curved surface which ends in the core root.

17. A method for manufacturing a gas turbine blade using the appliance as claimed in claim 16, comprising:

casting the distribution space and the supply ducts using the casting core.

18. A method for manufacturing a gas turbine blade using the appliance as claimed in claim 12, comprising:

casting the distribution space and the supply ducts using the casting core.

19. The gas turbine blade as claimed in claim 1, wherein the inlet openings are adjacent to one another in a manner which optimizes the flow.

* * * * *